US007798793B2

(12) United States Patent
Shoulders

(10) Patent No.: US 7,798,793 B2
(45) Date of Patent: Sep. 21, 2010

(54) COMPRESSOR SLIDE VALVE LUBRICATION

(75) Inventor: Stephen L. Shoulders, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 11/721,606

(22) PCT Filed: Feb. 7, 2005

(86) PCT No.: PCT/US2005/003819

§ 371 (c)(1),
(2), (4) Date: Jun. 13, 2007

(87) PCT Pub. No.: WO2006/085866

PCT Pub. Date: Aug. 17, 2006

(65) Prior Publication Data

US 2008/0095653 A1 Apr. 24, 2008

(51) Int. Cl.
*F01C 1/24* (2006.01)
*F03C 2/00* (2006.01)
*F03C 4/00* (2006.01)

(52) U.S. Cl. ..... 418/201.2; 418/201.1; 418/270; 417/282; 417/310; 251/61.4

(58) Field of Classification Search ..... 418/201.2, 418/201.1, 180, 87; 417/282, 310; 215/61.4
See application file for complete search history.

(56) References Cited

U.S. PATENT DOCUMENTS

| | | | | |
|---|---|---|---|---|
| 3,314,597 | A | 4/1967 | Schibbye | |
| 3,432,089 | A | 3/1969 | Schibbye | |
| 3,913,346 | A | 10/1975 | Moody, Jr. et al. | |
| RE29,283 | E | 6/1977 | Shaw | |
| 4,234,296 | A | 11/1980 | Matsubara et al. | |
| 4,244,554 | A | 1/1981 | DiMauro et al. | |
| 4,249,866 | A | 2/1981 | Shaw et al. | |
| 4,335,582 | A | 6/1982 | Shaw et al. | |
| 4,515,540 | A | 5/1985 | Pillis | |
| 6,302,668 | B1 | 10/2001 | Lee | |
| 6,616,432 | B2 * | 9/2003 | Szczepanski et al. | 418/126 |
| 6,739,853 | B1 | 5/2004 | Tang et al. | |

FOREIGN PATENT DOCUMENTS

| | | | | |
|---|---|---|---|---|
| GB | 458379 | * | 12/1936 | |
| GB | 1370100 | A | 10/1974 | |
| JP | 57163190 | A * | 10/1982 | 418/126 |
| NL | 7411566 | A | 11/1974 | |

OTHER PUBLICATIONS

Heinz P. Bloch, A Practical Guide to Compressor Technology, Figure 9.13, 1996, McGraw-Hill, US.
European Search Report for EP05713021.3, dated Apr. 1, 2009.

* cited by examiner

*Primary Examiner*—Theresa Trieu
(74) *Attorney, Agent, or Firm*—Bachman & LaPointe, P.C.

(57) ABSTRACT

A compressor (20) has an unloading slide valve (100). The valve has a valve element (102) having a range between a first condition and a second condition, the second condition being unloaded relative to the first condition. A first surface (200) of the valve element (102) is in sliding engagement with a second surface (202) of the housing (22) during movement between the first and second conditions. The compressor includes means for lubricating the first (200) and second (202) surfaces.

17 Claims, 8 Drawing Sheets

COMPRESSOR SLIDE VALVE LUBRICATION

BACKGROUND OF THE INVENTION

The invention relates to compressors. More particularly, the invention relates to refrigerant compressors.

Screw-type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone). In one implementation, the male rotor is coaxial with an electric driving motor and is supported by bearings on inlet and outlet sides of its lobed working portion. There may be multiple female rotors engaged to a given male rotor or vice versa.

When one of the interlobe spaces is exposed to an inlet port, the refrigerant enters the space essentially at suction pressure. As the rotors continue to rotate, at some point during the rotation the space is no longer in communication with the inlet port and the flow of refrigerant to the space is cut off. After the inlet port is closed, the refrigerant is compressed as the rotors continue to rotate. At some point during the rotation, each space intersects the associated outlet port and the closed compression process terminates. The inlet port and the outlet port may each be radial, axial, or a hybrid combination of an axial port and a radial port.

It is often desirable to temporarily reduce the refrigerant mass flow through the compressor by delaying the closing off of the inlet port (with or without a reduction in the compressor volume index) when full capacity operation is not required. Such unloading is often provided by a slide valve having a valve element with one or more portions whose positions (as the valve is translated) control the respective suction side closing and discharge side opening of the compression pockets. The primary effect of an unloading shift of the slide valve is to reduce the initial trapped suction volume (and hence compressor capacity); a reduction in volume index is a typical side effect. Exemplary slide valves are disclosed in U.S. Patent Application Publication No. 20040109782 A1 and U.S. Pat. Nos. 4,249,866 and 6,302,668.

SUMMARY OF THE INVENTION

According to one aspect of the invention, a compressor has an unloading slide valve. The valve has a valve element having a range between a first condition and a second condition, the second condition being unloaded relative to the first condition. A first surface of the valve element is in sliding engagement with a second surface of the housing during movement between the first and second conditions. The compressor includes means for lubricating the first and second surfaces.

In various implementations, the means may include a passageway through or along a support for the valve element extending into a discharge plenum. The means may include a passageway through or along the housing. The means may be provided in a remanufacturing of a compressor or the reengineering of a compressor configuration from an initial baseline configuration.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
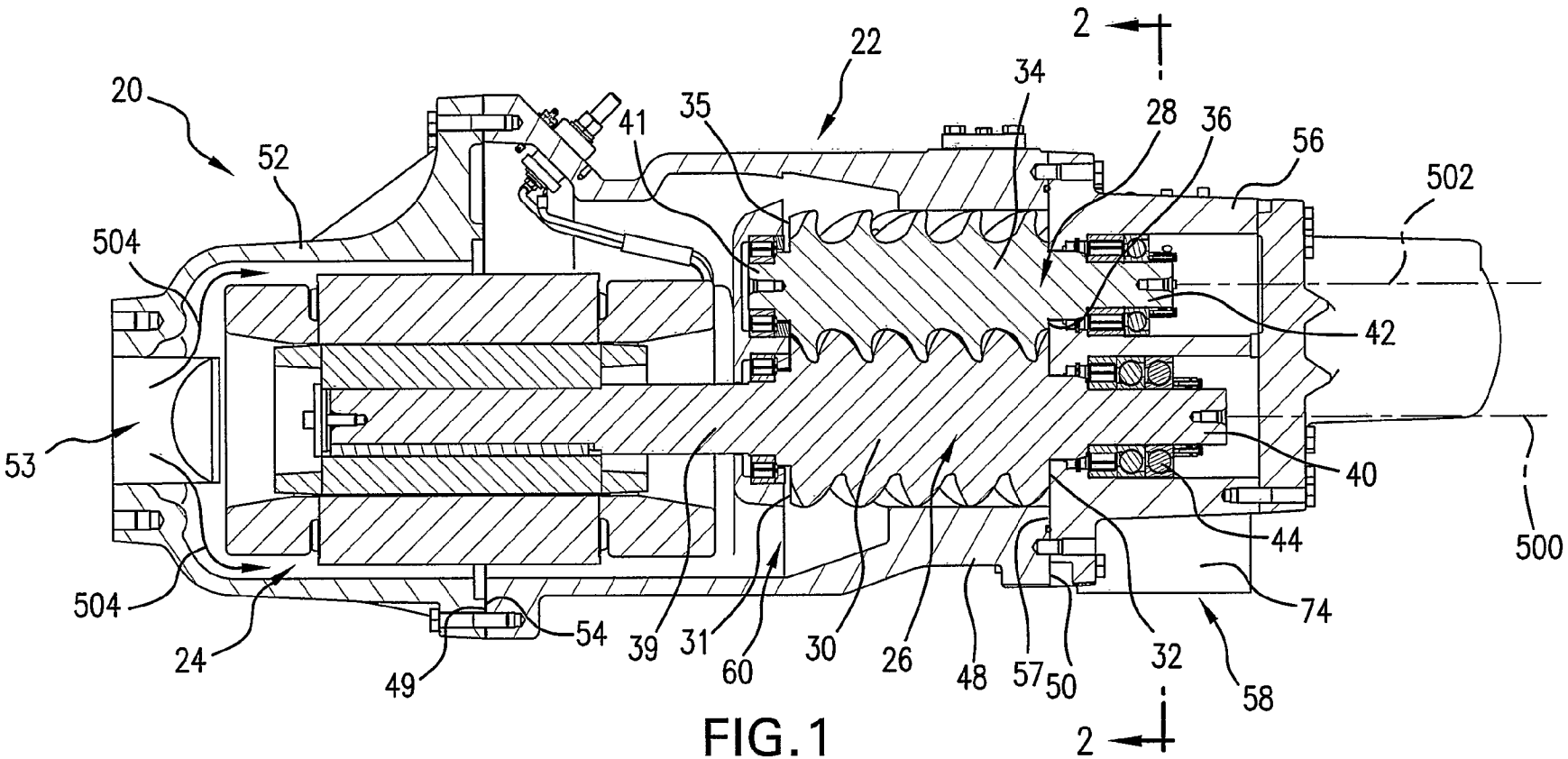
FIG. 1 is a longitudinal sectional view of a compressor.

FIG. 1 shows a compressor 20 having a housing assembly 22 containing a motor 24 driving rotors 26 and 28 having respective central longitudinal axes 500 and 502. In the exemplary embodiment, the rotor 26 has a male lobed body or working portion 30 extending between a first end 31 and a second end 32. The working portion 30 is enmeshed with a female lobed body or working portion 34 of the female rotor 28. The working portion 34 has a first end 35 and a second end 36. Each rotor includes shaft portions (e.g., stubs 39, 40, 41, and 42 unitarily formed with the associated working portion) extending from the first and second ends of the associated working portion. Each of these shaft stubs is mounted to the housing by one or more bearing assemblies 44 for rotation about the associated rotor axis.

In the exemplary embodiment, the motor is an electric motor having a rotor and a stator. One of the shaft stubs of one of the rotors 26 and 28 may be coupled to the motor's rotor so as to permit the motor to drive that rotor about its axis. When so driven in an operative first direction about the axis, the rotor drives the other rotor in an opposite second direction. The exemplary housing assembly 22 includes a rotor housing 48 having an upstream/inlet end face 49 approximately midway along the motor length and a downstream/discharge end face 50 essentially coplanar with the rotor body ends 32 and 36. Many other configurations are possible.

The exemplary housing assembly 22 further comprises a motor/inlet housing 52 having a compressor inlet/suction port 53 at an upstream end and having a downstream face 54 mounted to the rotor housing downstream face (e.g., by bolts through both housing pieces). The assembly 22 further includes an outlet/discharge housing 56 having an upstream face 57 mounted to the rotor housing downstream face and having an outlet/discharge port 58. The exemplary rotor housing, motor/inlet housing, and outlet housing 56 may each be formed as castings subject to further finish machining.

Figure 2:
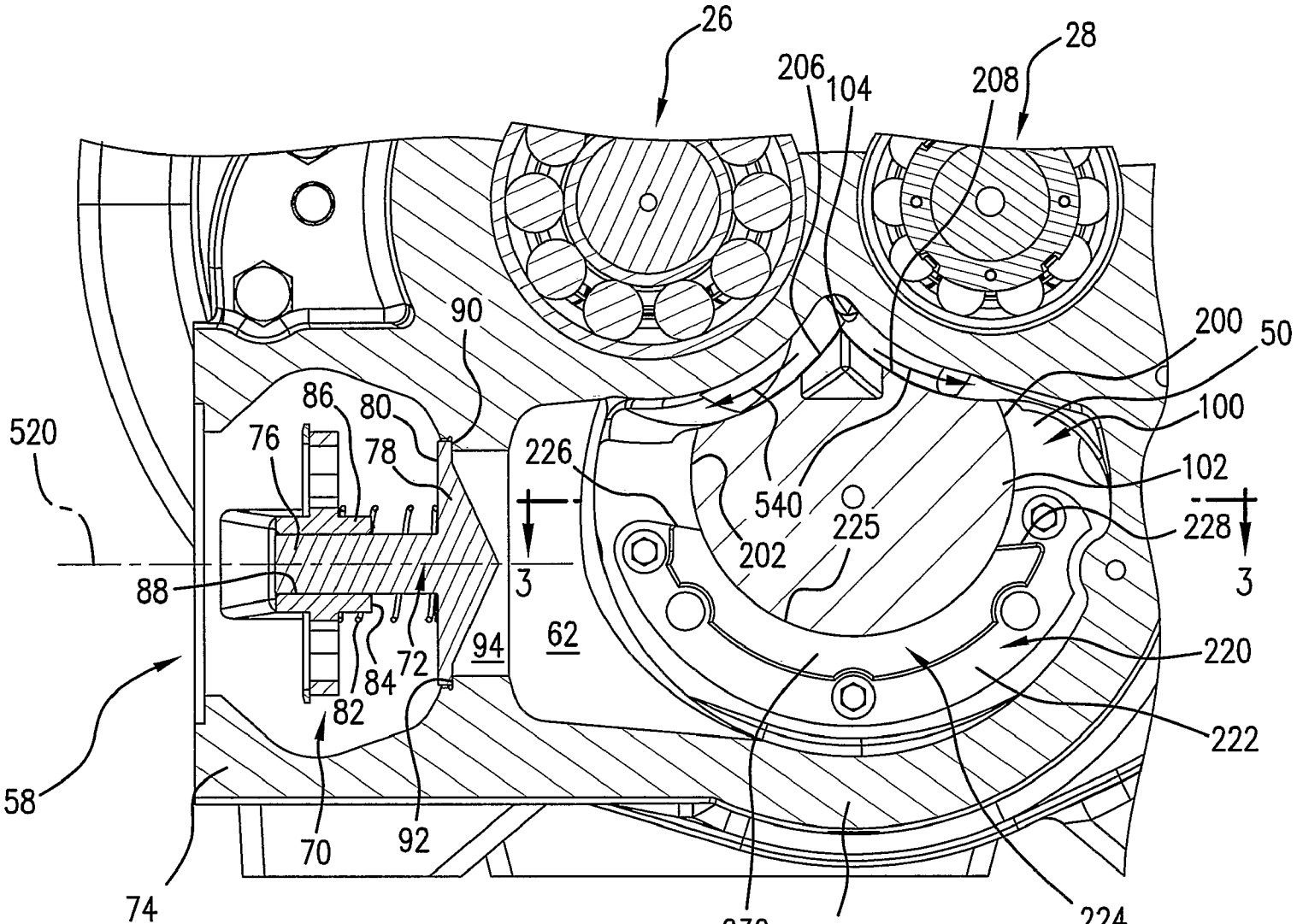
FIG. 2 is a transverse sectional view of a discharge plenum of the compressor of FIG. 1, taken along line 2-2 and showing a slide valve support.

Surfaces of the housing assembly 22 combine with the enmeshed rotor bodies 30 and 34 to define inlet and outlet ports to compression pockets compressing and driving a refrigerant flow 504 from a suction (inlet) plenum 60 to a discharge (outlet) plenum 62 (FIG. 2). A series of pairs of male and female compression pockets are formed by the housing assembly 22, male rotor body 30 and female rotor body 34. Each compression pocket is bounded by external surfaces of enmeshed rotors, by portions of cylindrical surfaces of male and female rotor bore surfaces in the rotor case and continuations thereof along a slide valve, and portions of face 57.

FIG. 2 shows further details of the exemplary flowpath at the outlet/discharge port 58. A check valve 70 is provided having a valve element 72 mounted within a boss portion 74 of the outlet housing 56. The exemplary valve element 72 is a front sealing poppet having a stem/shaft 76 unitarily formed with and extending downstream from a head 78 along a valve axis 520. The head has a back/underside surface 80 engaging an upstream end of a compression bias spring 82 (e.g., a metallic coil). The downstream end of the spring engages an upstream-facing shoulder 84 of a bushing/guide 86. The bushing/guide 86 may be unitarily formed with or mounted relative to the housing and has a central bore 88 slidingly accommodating the stem for reciprocal movement between an open condition (not shown) and a closed condition of FIG. 2. The spring 82 biases the element 72 upstream toward the closed condition. In the closed condition, an annular peripheral seating portion 90 of the head upstream surface seats against an annular seat 92 at a downstream end of a port 94 from the discharge plenum.

For capacity control/unloading, the compressor has a slide valve 100 having a valve element 102. The valve element 102 has a portion 104 along the mesh zone between the rotors (i.e., along the high pressure cusp). The exemplary valve element has a first portion 106 (FIG. 3) at the discharge plenum and a second portion 108 at the suction plenum. The valve element is shiftable to control compressor capacity to provide unloading. The exemplary valve is shifted via linear translation parallel to the rotor axes.

Figure 3:
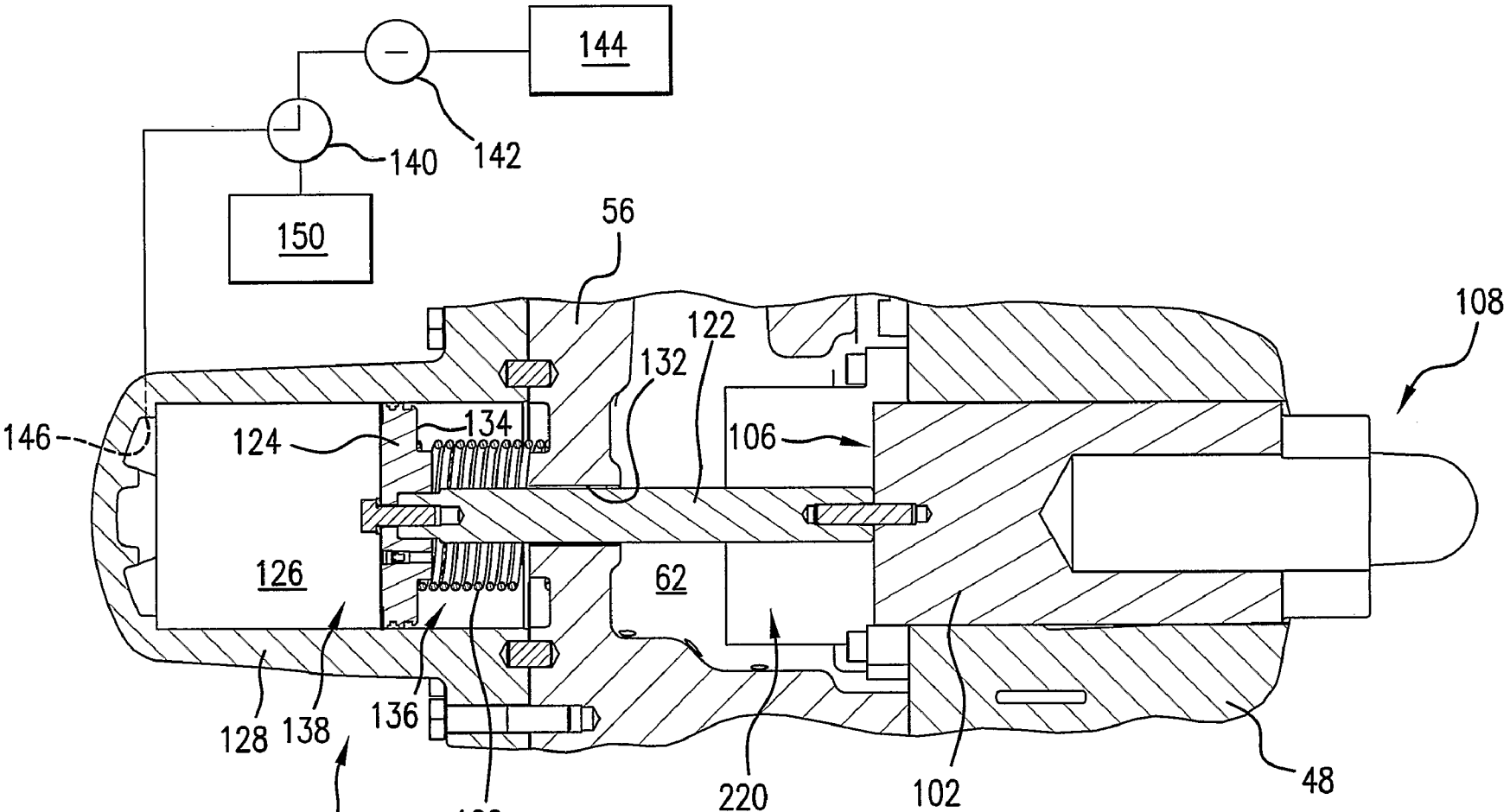
FIG. 3 is a sectional view of a slide valve assembly of the discharge plenum of FIG. 2 in a fully loaded condition, taken along line 3-3.
Figure 4:
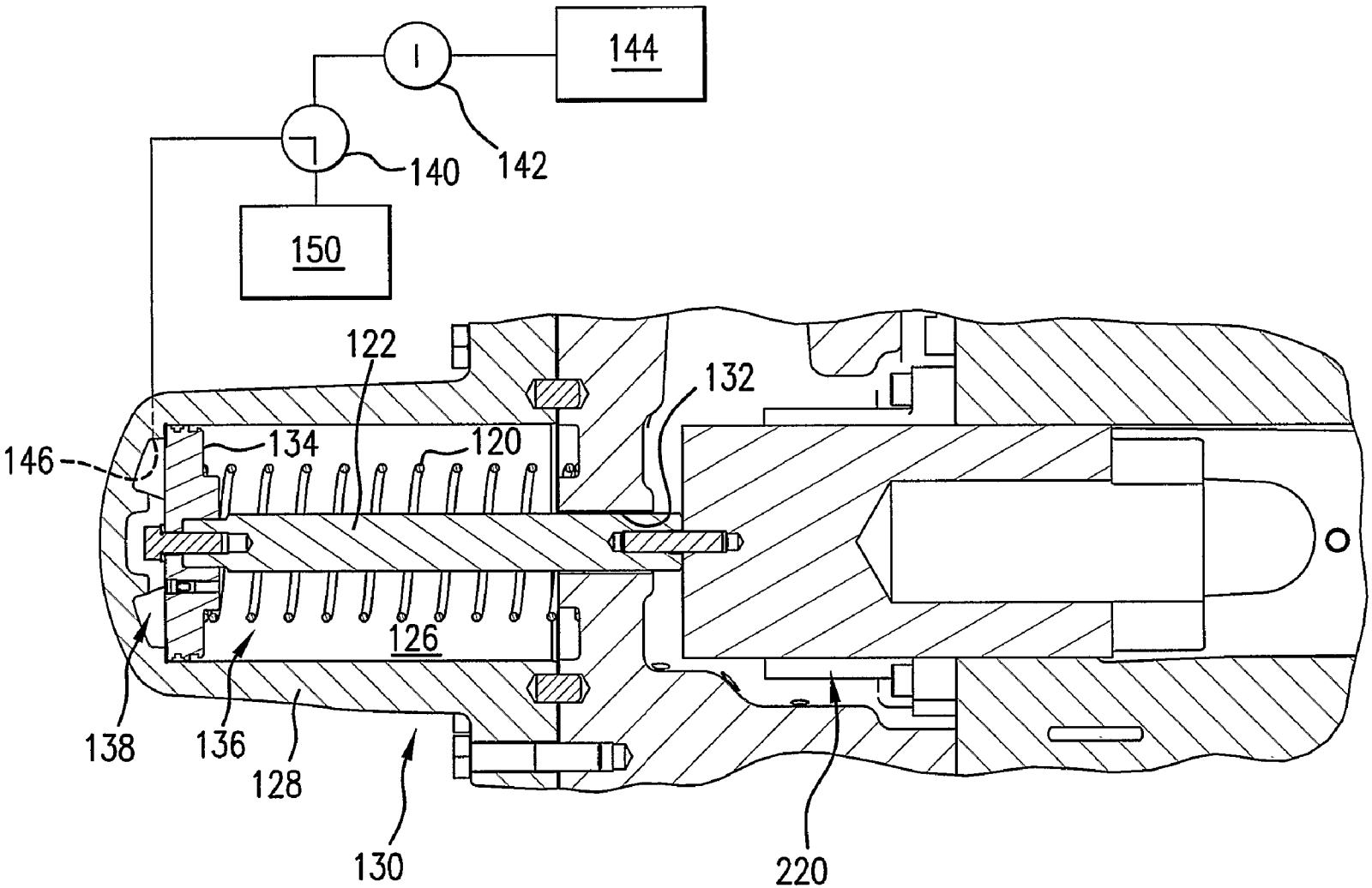
FIG. 4 is a view of the slide valve of FIG. 3 in a relatively unloaded condition.

FIG. 3 shows the valve element at an upstream-most position in its range of motion. In this position, the compression pockets close relatively upstream and capacity is a relative maximum (e.g., at least 90% of a maximum displacement volume for the rotors, and often about 99%). FIG. 4 shows the valve element shifted to a downstream-most position. Capacity is reduced in this unloaded condition (e.g., to a displacement volume less than 40% of the FIG. 3 displacement volume or the maximum displacement volume, and often less than 30%). In the exemplary slide valve, shifts between the two positions are driven by a combination of spring force and fluid pressure. A main spring 120 biases the valve element from the loaded to the unloaded positions. In the exemplary valve, the spring 120 is a metal coil spring surrounding a shaft 122 coupling the valve element to a piston 124. The piston is mounted within a bore (interior) 126 of a cylinder 128 formed in a slide case element 130 attached to the outlet case. The shaft passes through an aperture 132 in the outlet case. The spring is compressed between an underside 134 of the piston and the outlet case. A proximal portion 136 of the cylinder interior is in pressure-balancing fluid communication with the discharge plenum via clearance between the aperture and shaft. A headspace 138 is coupled via electronically-controlled solenoid valves 140 and 142 (shown schematically) to one of: a high pressure fluid source 144 at or near discharge conditions (e.g., to an oil separator); and a low pressure drain/sink 150 which may be at or near suction conditions (e.g., an oil return). A port 146 is schematically shown in the cylinder at the headspace at the end of a conduit network connecting the valves 140 and 142. In an exemplary implementation, the portions of the conduit network may be formed within the castings of the housing components.

The loaded position/condition of FIG. 3 can be achieved by coupling the headspace 138 to the source 144 and isolating it from drain/sink 150 by appropriate control of valves 140 and 142. The unloaded position/condition of FIG. 4 can be achieved by coupling the headspace 138 to the drain/sink 150 and isolating it from source 144 by appropriate control of valves 140 and 142. Intermediate (partly loaded) positions, not shown, can be achieved by alternating connection of headspace 138 to either the source 144 or the drain/sink 150 using appropriately chosen spans of time for connection to each, possibly in combination with isolating the headspace 138 from both source 144 and drain/sink 150 for an appropriately chosen span of time (e.g., via appropriate modulation techniques).

Returning to FIG. 2, the interfitting of the slide valve element 102 and the rotor housing is seen. The slide valve element 102 has a circular cylindrical exterior surface portion 200 singly convex. This is closely accommodated within a rotor housing bore defined by a circular cylindrical interior surface portion 202 extending from the rotor housing end surface 50. During loading and unloading, there is linear sliding interaction between the surfaces 200 and 202. FIG. 2 further shows concave circular cylindrical exterior surface portions 206 and 208 of the element 102 in close proximity to the lobes of the rotors 26 and 28, respectively. The sliding interaction between the surfaces 200 and 202 may potentially damage one or both of the surfaces 200 and 202. It may, accordingly, be desirable to provide additional support for the valve element 102 and to provide lubrication.

To provide additional support to the valve element 102, a shelf-like support member 220 (FIG. 2) is located in the discharge plenum 62. The exemplary support 220 includes a mounting flange 222 fastened against the rotor housing discharge end surface 50. Extending from the opposite surface of the flange 222, is a sleeve segment 224 unitarily formed therewith. The sleeve 224 has an upper/inboard surface 225 locally aligned with the surface 202 to combine therewith to engage the surface 200. The sleeve has first and second longitudinal edges 226 and 228 and a distal end or rim 230. An exemplary circumferential span along the surface 200 between the edges 226 and 228 is 90-180°, more narrowly 120-160°.

The support 220 may further include features for assisting in lubrication of the sliding interaction between the surface 200 on the one hand and the surfaces 202 and 225 on the other hand. One feature involves declination of the edges 226 and 228 toward the element 102. As refrigerant flow 540 exits the compression pockets and passes beyond the surfaces 206 and 208, entrained oil may fall onto the edge surfaces 226 and 228. The declination directs this oil between the surfaces 200 and 225. As the valve reciprocates during cycles of loading and unloading, some of this oil is further passed upstream and downstream to lubricate the interaction between the surfaces 200 and 202. Exemplary declination is at least 5° (approximately 10° being shown). Additional volumes of oil accumulation on surfaces 226 and 228 can be achieved by increasing the declination even more (e.g., to 30-45°). Alternatively, additional volumes of oil accumulation can be achieved using multi-faceted surfaces with at least the surfaces in closest proximity to valve 102 having greater declination (e.g., such surfaces 340 and 342 in FIG. 5 discussed below).

Figure 5:
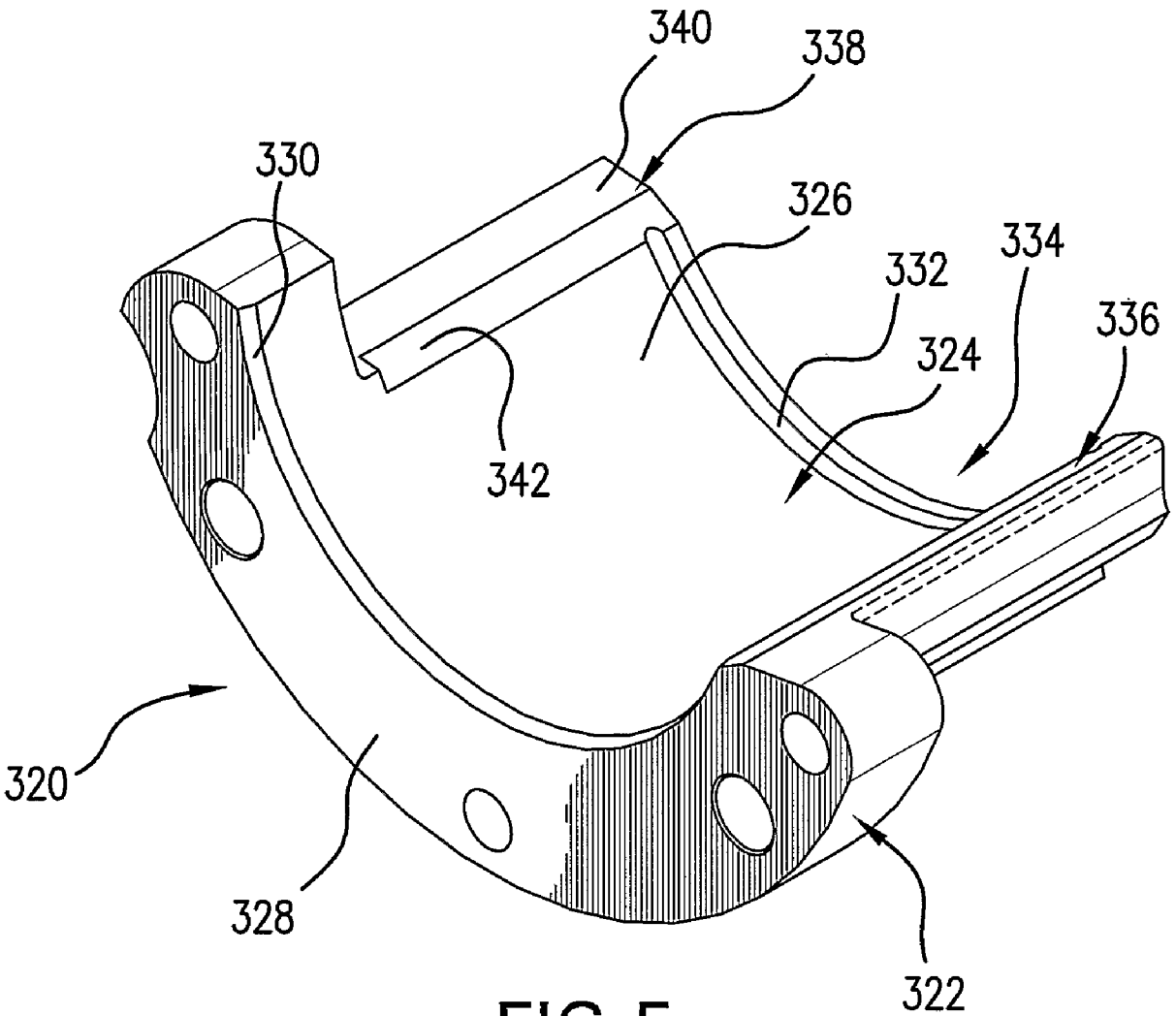
FIG. 5 is a view of a first alternative slide valve support.

Yet further lubrication features may be incorporated into the support 220. These features may supplement or replace the leakage/seepage flow from the edges into the fine clearance between slide valve surface 200 and support surface 225. These features may more substantially direct lubricant flow. FIG. 5 shows an alternative support 320 having a flange 322 and a sleeve segment 324. The junction between the concave cylindrical portion of the inboard/upper surface 326 and the upstream face 328 of the flange 322 has a bevel 330. A small amount of oil can become trapped in this bevel (e.g., a 15° bevel 4 mm in length) to maintain lubrication. Oil initially collected on one or both edges will flow down the lateral sides of the channel (formed by the bevel and the adjacent rotor housing face) to accumulate in the bottom and lubricate the surface 200 (and therefrom the surfaces 202 and 326).

FIG. 5 further shows a circumferential channel 332 in the surface 326 slightly recessed from the distal end 334 of the sleeve segment. The channel 332 joins the edges 336 and 338 to partially receive oil collected by the edges. The exemplary edges are doubly faceted with each having a laterally outboard portion 340 at a relatively shallow declination (e.g., 10°) and a portion 342 inboard thereof and more declined (e.g., at an angle of 30°).

Figure 6:
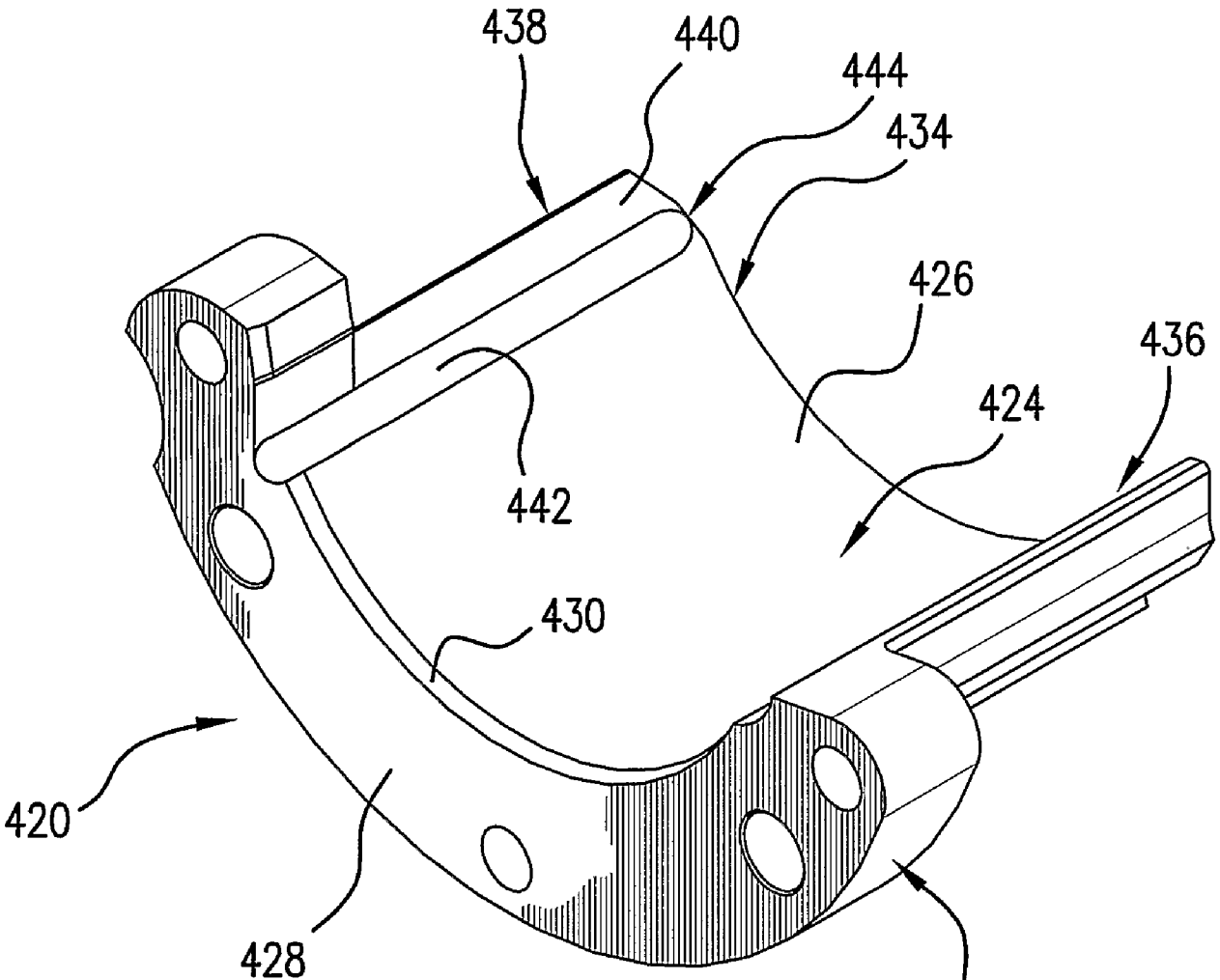
FIG. 6 is a view of a second alternative slide valve support.

FIG. 6 shows yet another alternative support 420 having a flange 422 and a sleeve segment 424. The sleeve 424 has an inboard/upper surface 426. A bevel 430 is formed at the junction with the flange upstream surface 428. Along each of the edges 436 and 438, and inboard of a face 440, a relieved area 442 extends. However, first the relieved area does not reach the distal end 434 but terminates just before it. The relieved area also extends through the flange 422 to communicate with the bevel. Thus, in operation, the relieved areas 442 due to unrelieved distal portions 444 may trap a substantial accumulation of oil against the valve element. This oil may then be directed to the bevel 430 to provide greater circumferential coverage.

Figure 7:
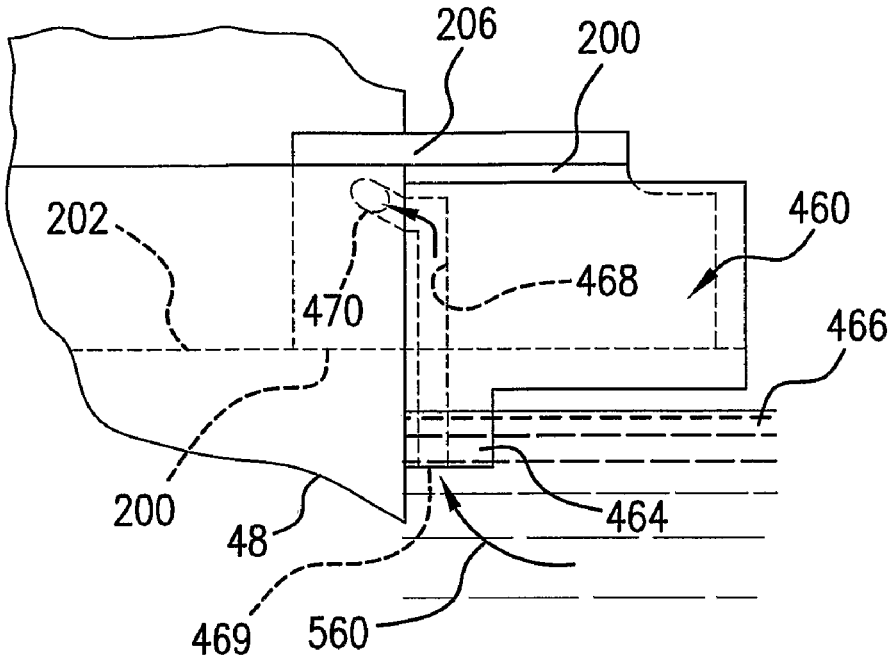
FIG. 7 is a partial schematic view of a third alternative slide valve support installed.
Figure 8:
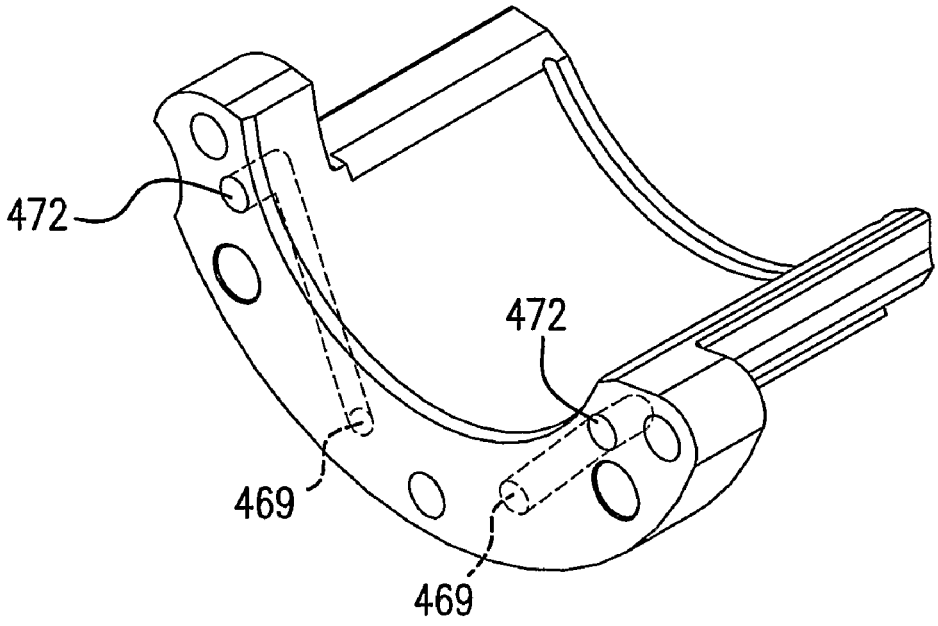
FIG. 8 is a view of the alternative slide valve support of FIG. 7.

FIG. 7 shows an alternative support 460 wherein the flange 464 is partially immersed in an oil accumulation 466 in the discharge plenum. One or more passageways 468 extend from one or more inlets 469 low on the periphery of the flange (e.g., one passageway on each side). The passageways extend through the flange and into the rotor housing 48 to outlet ports 470 in the bore surface 202. The exemplary ports 470 are near the junctions of the slide valve element surface 200 and the surface 206 at one side and 208 at the other. The closer physical proximity of the ports 470 to suction conditions helps cause a pressure-induced flow 560 of oil to lubricate the surfaces 200 and 202. FIG. 8 shows intermediate ports 472 in the upstream face of the flange which align with associated intermediate ports (not numbered) on the rotor case end face 50.

Figure 9:
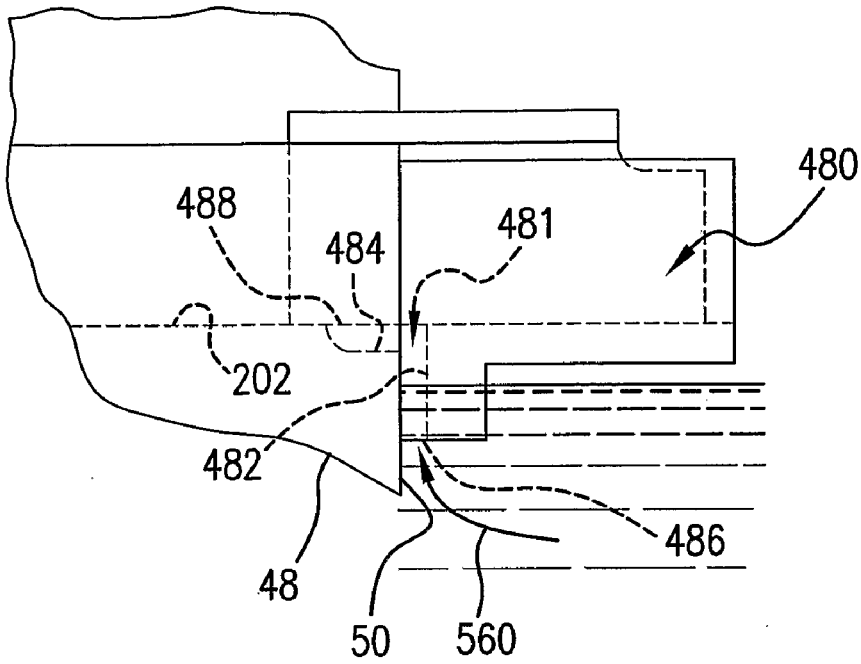
FIG. 9 is a partial schematic view of a fourth alternative slide valve support installed.

FIG. 9 shows an alternative support 480 wherein, for ease of machining, a passageway 481 is formed by an open channel 482 in the flange suction side surface (closed by the face 50) in combination with an open channel 484 in the rotor case bore extending along a bottom end of the surface 202. the passageway has an inlet 486 and an outlet 488.

Figure 10:
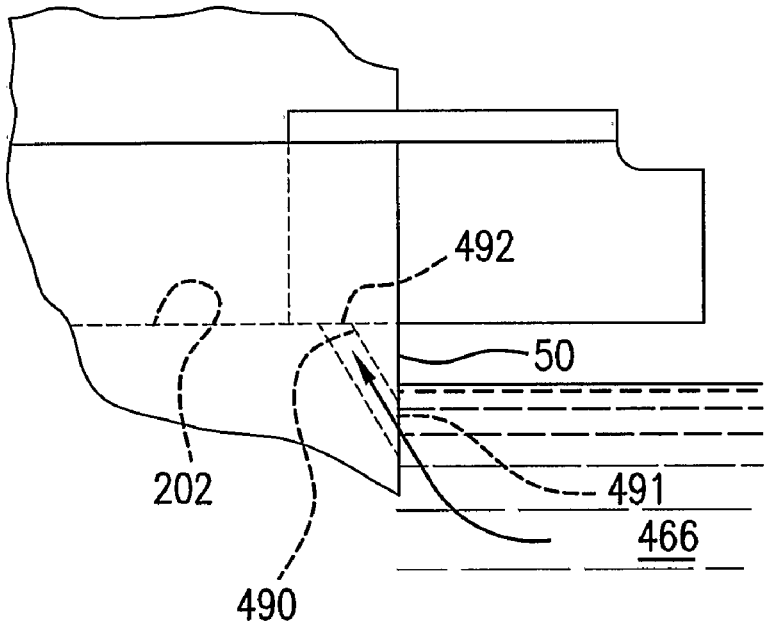
FIG. 10 is a partial schematic view of a slide valve lubrication passageway in a rotor housing.

FIG. 10 shows an alternate embodiment wherein a passageway 490 extends solely through the rotor housing from an inlet port 491 in the surface 50 below the surface of the accumulation 466 and to an outlet port 492 in the surface 202. For this construction, the support (not shown) is optional.

One or more embodiments of the present invention have been described. Nevertheless, it will be understood that various modifications may be made without departing from the spirit and scope of the invention. For example, in a reengineering or remanufacturing situation, details of the existing compressor configuration may particularly influence or dictate details of the implementation. Accordingly, other embodiments are within the scope of the following claims.

What is claimed is:

1. A compressor apparatus (20) comprising:

a housing (22) having first (53) and second (58) ports along a flow path;

one or more working elements (26; 28) cooperating with the housing to define a compression path between suction (60) and discharge (62) locations along the flow path;

an unloading slide valve (100) having a valve element (102) having a range between a first condition and a second condition, the second condition being unloaded relative to the first condition, a first surface (200) of the valve element (102) in sliding engagement with a second surface (202) of the housing (22) during movement between the first and second conditions; and means for lubricating the first (200) and second (202) surfaces, wherein:

the range is a range of linear translation;

the second surface (202) is in a rotor case (48); and the means is at least partially formed on a support (220; 320; 420; 460; 480) extending from a downstream face (50) of said rotor case (48) into a discharge plenum (62) and comprises declined edges (226, 228; 336, 338; 436, 438) of a sleeve segment extending from a mounting flange.

2. The apparatus of claim 1 wherein:

the sleeve segment has a generally concave cylindrical upper surface (225; 326; 426) extending into the mounting flange; and the means includes a bevel at a junction of the upper surface and an upstream face of the mounting flange.

3. The apparatus of claim 2 wherein:

the means includes an at least partially circumferential channel in the upper surface.

4. The apparatus of claim 1 wherein:

the means comprises longitudinal channels formed along the declined edges of the support and cooperating with the valve element to trap oil.

5. The compressor of claim 4 wherein the one or more working elements include:

a male-lobed rotor (26) having a first rotational axis (500); and a female-lobed rotor (28) having a second rotational axis (502) and enmeshed with the male-lobed rotor.

6. The compressor of claim 5 wherein:

in the first condition, the compressor is at least at 90% of a maximum displacement volume; and in the second condition, compressor is at less than 40% of the first condition displacement volume.

7. The apparatus of claim 1 wherein:

the means comprises a passageway extending from a discharge end face (50) of a rotor case (48) of the housing (22).

8. A method for remanufacturing a compressor (20) or reengineering a configuration of the compressor comprising:

providing an initial such compressor or configuration having:

a housing (22);

one or more working elements (26; 28) cooperating with the housing to define a compression path between suction (60) and discharge (62) locations; and an unloading slide valve (100) having a valve element (102) having a range between a first condition and a second condition, the second condition being unloaded relative to the first condition, a first surface (200) of the valve element (102) in sliding engagement with a second surface (202) of the housing (22) during movement between the first and second conditions; and adapting such compressor or configuration to include means for lubricating the first (200) and second (202) surfaces, the adapting including modifying a support extending (220; 320; 420; 460; 480) into a discharge plenum (62), the modifying comprising adding a channel in an upper surface of the support.

9. The method of claim 8 wherein the adding comprises adding a passageway (490) through a rotor case (48) of the housing (22).

10. The method of claim 8 wherein the adding comprises adding a passageway (468; 481; 490) at least partially through a rotor case (48) of the housing (22) generally upward from a port (469; 486; 491) positioned to be within an oil accumulation in the discharge plenum (62).

11. A compressor apparatus (20) comprising:

a housing (22) having first (53) and second (58) ports along a flow path;

one or more working elements (26; 28) cooperating with the housing to define a compression path between suction (60) and discharge (62) locations along the flow path;

an unloading slide valve (100) having a valve element (102) having a range between a first condition and a second condition, the second condition being unloaded relative to the first condition, a first surface (200) of the valve element (102) in sliding engagement with a second surface (202) of the housing (22) during movement between the first and second conditions; and a support (220; 320; 420; 460; 480) extending from a downstream face (50) of said rotor case (48) into a discharge plenum (62) and having declined edges (226, 228; 336, 338; 436, 438) positioned to guide lubricant to the first (200) and second (202) surfaces.

12. The apparatus of claim 11 wherein:

the support comprises a sleeve segment extending from a mounting flange.

13. The apparatus of claim 12 wherein:

the sleeve segment has a generally concave cylindrical upper surface (225; 326; 426) extending into the mounting flange; and a bevel is formed at a junction of the upper surface and an upstream face of the mounting flange.

14. The apparatus of claim 13 wherein:

an at least partially circumferential channel is formed in the upper surface.

15. The apparatus of claim 11 wherein:

an at least partially circumferential channel is formed in an upper surface of the support.

16. A method for using the apparatus of claim 11 comprising:

rotating the one or more elements to compress a flow of fluid passing along the flow path;

shifting the valve element between the first condition and the second condition, during a portion of the shifting, the valve element being partially supported by the support; and collecting lubricant on the declined edges, the edges guiding the lubricant between the first surface and, therefrom, to the second surface.

17. A compressor apparatus (20) comprising:

a housing (22) having first (53) and second (58) ports along a flow path;

one or more working elements (26; 28) cooperating with the housing to define a compression path between suction (60) and discharge (62) locations along the flow path;

an unloading slide valve (100) having a valve element (102) having a range between a first condition and a second condition, the second condition being unloaded relative to the first condition, a first surface (200) of the valve element (102) in sliding engagement with a second surface (202) of the housing (22) during movement between the first and second conditions;

means for lubricating the first (200) and second (202) surfaces, wherein:

the range is a range of linear translation;

the second surface (202) is in a rotor case (48);

the means is at least partially formed on a support (220; 320; 420; 460; 480) extending from a downstream face (50) of said rotor case (48) into a discharge plenum (62) and comprises declined edges (226, 228; 336, 338; 436, 438) of a sleeve segment extending from a mounting flange;

the support comprises a mounting flange and a sleeve segment extending from the mounting flange, the mounting flange fastened to the rotor case and the sleeve segment having a concave upper surface positioned to engage the first surface of the valve element; and the means comprises a channel at least partially formed on the support.

* * * * *